US006390385B1

(12) United States Patent
Hardy et al.

(10) Patent No.: US 6,390,385 B1
(45) Date of Patent: May 21, 2002

(54) FUEL INJECTOR

(75) Inventors: Martin Paul Hardy; Michael Peter Cooke, both of Gillingham; Andrew John Hargreaves, Boughton; Malcolm David Dick Lambert, Bromley, all of (GB)

(73) Assignee: Delphi Technologies, Inc., Troy, MI (US)

( * ) Notice: Subject to any disclaimer, the term of this patent is extended or adjusted under 35 U.S.C. 154(b) by 9 days.

(21) Appl. No.: 09/699,014

(22) Filed: Oct. 27, 2000

(30) Foreign Application Priority Data

Oct. 29, 1999 (GB) ..... 9925753

(51) Int. Cl.[7] ..... B05B 1/08; F02M 47/02

(52) U.S. Cl. ..... 239/102.2; 239/88; 239/96; 239/584; 239/533.7; 239/533.9; 239/124; 251/129.06

(58) Field of Search ..... 239/102.1, 102.2, 239/88–92, 96, 124, 533.7, 533.8, 533.9, 453; 251/129.01, 129.66

(56) References Cited

U.S. PATENT DOCUMENTS 4,579,283 A * 4/1986 Igashira et al. ..... 239/88
6,062,489 A * 5/2000 Tokumaru ..... 239/124
6,196,472 B1 * 3/2001 Cooke ..... 239/102.2
6,299,074 B1 * 10/2001 Cooke ..... 239/102.2

* cited by examiner

*Primary Examiner*—Steven J. Ganey
(74) *Attorney, Agent, or Firm*—Thomas N. Twomey

(57) ABSTRACT

A piezoelectrically actuable fuel injector comprising an accumulator volume within which a piezoelectric stack is arranged, the accumulator volume being arranged to receive fuel from a source of pressurized fuel, in use. The piezoelectric stack carrying an end member which engages a surface associated with a piston member so as to apply a retracting force to the piston member upon a reduction in the axial length of the piezoelectric stack, the piston member being operable to control fuel pressure within a control chamber. A volume is defined between the end member and the surface associated with the piston member. The volume is provided with a vent arrangement to permit fuel within the volume to flow to a low pressure drain.

15 Claims, 3 Drawing Sheets

FUEL INJECTOR

This invention relates to a fuel injector for use in the delivery of fuel to a combustion space of an internal combustion engine. In particular, the invention relates to a fuel injector of the type intended for use in a fuel system of the accumulator or common rail type, the injector being of the type controlled using a piezoelectric actuator.

In a known piezoelectrically actuated fuel injector, a piezoelectric actuator is operable to control the position occupied by a control piston member, the piston being moveable to control the fuel pressure within a control chamber defined, in part, by a surface associated with the valve needle of the injector to control movement of the injector. The piezoelectric actuator includes a stack of piezoelectric elements, the energisation level, and hence the axial length, of the stack being controlled by applying a voltage across the stack. The lower end of the piezoelectric stack carries an anvil member including a part-spherical recess which engages a part-spherical upper region of the control piston member in a sealing manner. A small volume is defined between these two components such that, in use, when the axial length of the piezoelectric stack is reduced causing the anvil member to move in an upwards direction, fuel pressure within the volume is reduced, serving to draw the control piston member to move with the stack.

A disadvantage of this type of arrangement is that high quality surfaces are required on the anvil member and the control piston member to achieve a level of sealing which is sufficient to ensure the control piston member is caused to move with the anvil member. Furthermore, the seal formed between these components is sensitive to debris which may become trapped between them. These disadvantageous effects can cause the anvil member and the control piston member to become separated, in use, during injecting stages of the fuel injection cycle.

It is an object of the invention to provide a fuel injector in which the disadvantageous effects described hereinbefore are reduced.

According to the present invention, there is provided a piezoelectrically actuable fuel injector comprising an accumulator volume within which a piezoelectric stack is arranged, the accumulator volume being arranged to receive fuel from a source of pressurized fuel, in use, the piezoelectric stack carrying an end member which engages a surface associated with a piston member so as to apply a retracting force to the piston member upon the axial length of the piezoelectric stack being reduced, the piston member being operable to control fuel pressure within a control chamber, a volume being defined between the end member and the surface associated with the piston member, the volume being provided with vent means to permit fuel within the volume to flow to a low pressure drain.

As the volume defined between the end member and the surface associated with the control piston member is able to vent to low pressure, the end member and the surface are more firmly engaged due to fuel under high pressure within the accumulator volume. Thus, upon retraction of the axial length of the piezoelectric stack and the application of a retracting force to the piston member, the risk of separation of the end member and the surface of the piston member is reduced. This permits opening movement of the valve needle of the fuel injector to be damped, thereby improving the control of valve needle movement and enabling relatively small quantities of fuel to be injected with improved accuracy.

Conveniently, the vent means may take the form of a passage, one end of the passage communicating with the volume and the other end of the passage communicating with the low pressure drain. The passage may be defined by a tubular member housed within the accumulator volume. Alternatively, the piezoelectric stack may be provided with a first bore, the passage being defined by a tubular member passing through the first bore provided in the stack or by the first bore itself.

The piston member conveniently includes a load transmitting member which defines the surface which engages the end member.

The fuel injector conveniently includes a valve needle which is slidable within a second bore and engageable with a seating to control fuel delivery through one or more outlet openings. The fuel injector may be of the inwardly opening type in which inward movement of the valve needle within the second bore causes fuel injection to be commenced.

The injector may further comprise damping means for damping movement of the piston member upon a reduction of the axial length of the piezoelectric stack. In this way, opening movement of the valve needle can be damped to improve control of valve needle movement.

Conveniently, the damping means may comprise a further chamber for fuel, the further chamber communicating with the accumulator volume by means of a restricted flow passage. Thus, in use, upon a reduction of the axial length of the piezoelectric stack and upward movement of the piston member, fuel within the accumulator volume is drawn through the restricted passage into the further chamber.

It is possible to damp opening movement of the valve needle as the risk of the end member and the surface associated with the piston member becoming separated is reduced. Thus, it is possible to provide an actuation stroke for a longer period of time in order to lift the valve needle away from its seating.

The further chamber may be provided with valve means operable in response to fuel pressure within the further chamber such that, upon movement of the piston member to reduce the volume of the further chamber, the valve means are caused to open to relieve fuel pressure within the further chamber.

This ensures closing movement of the valve needle is not hindered and fuel injection can be terminated rapidly.

The fuel injector may alternatively be of the outwardly opening type such that movement of the valve needle outwardly within the second bore causes fuel injection to be commenced.

The piston member may be provided with a piston bore which communicates with the volume, a first surface associated with the piston member being exposed to fuel pressure within the piston bore and a second surface of the piston member being exposed to fuel pressure within the control chamber.

Conveniently, the control chamber communicates with the accumulator volume such that, in use, during non-injecting stages of the injection cycle, fuel pressure within the control chamber is substantially the same as fuel pressure within the accumulator volume. Thus, leakage of fuel into the control chamber between fuel injections does not adversely affect fuel injector operation, as is the case in conventional fuel injectors of the outwardly opening type in which the control chamber is at reduced pressure during non-injecting stages of the injection cycle.

The invention will be described, by way of example, with reference to the accompanying drawings, in which.

Figure 1:
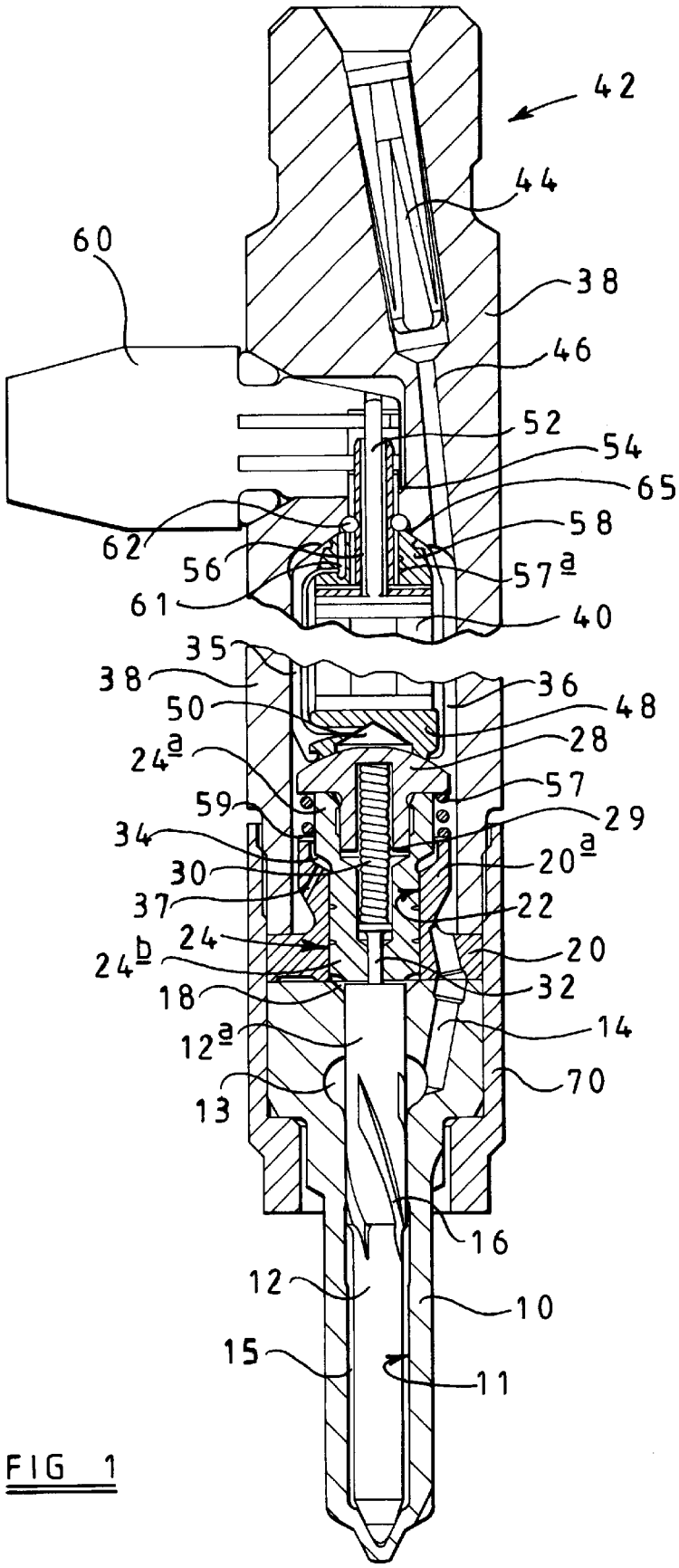
FIG. 1 is a sectional view illustrating a fuel injector in accordance with an embodiment of the invention.

Referring to FIG. 1, a fuel injector includes a nozzle body 10 provided with a blind bore 11 within which a valve needle 12 is reciprocable. The valve needle 12 is shaped for engagement with a seating defined by the blind end of the bore 11. The valve needle 12 is of stepped form and includes an enlarged region 12*a* having a diameter substantially equal to that of the adjacent part of the bore 11 which serves to guide the valve needle 12 for sliding movement within the bore 11, and a region of smaller diameter 12*b*. An enlarged region of the bore 11 defines an annular chamber 13 which communicates with a supply passage 14 provided in the nozzle body 10, the supply passage 14 communicating with a source of pressurized fuel, for example the common rail of a common rail fuel system. In use, fuel delivered to the annular chamber 13 is able to flow to a delivery chamber 15 defined between the region 12*b* of the valve needle 12 and the bore 11 by means of flats, slots or grooves 16 provided on the surface of the valve needle 12. It will be appreciated that engagement of the valve needle 12 with the seating defined by the bore 11 controls communication between the delivery chamber 15 and one or more outlet openings (not shown) located downstream of the seating.

The valve needle 12 defines an angled step at the interconnection of the enlarged region 12*a* and the smaller region 12*b*, the step forming a thrust surface which is exposed to fuel pressure within the delivery chamber 15 such that, when fuel under high pressure is supplied to the delivery chamber 15, a force is applied to the thrust surface to urge the valve needle 12 away from its seating. The upper end of the valve needle 12 is exposed to fuel pressure within a control chamber 18 defined, in part, by a recess formed in the upper end of the nozzle body 10, fuel pressure within the control chamber 18 acting to urge the valve needle 12 towards its seating to close communication between the delivery chamber 15 and the outlet openings.

The nozzle body 10 abuts, at its end remote from the outlet openings, a distance piece 20 including a projecting region 20*a* of reduced diameter. The distance piece 20 is provided with a through bore 22 within which a control piston member 24 of generally tubular form is slidable, the bore 22 including, at its uppermost end, a region of enlarged diameter. The piston member 24 is of stepped form and includes an enlarged upper end region 24*a*, slidable within the enlarged region of the bore 22 and a region 24*b* of smaller diameter. The piston member 24 is also provided with a piston bore and a load transmitting member 28 having an upper surface of part-spherical form and a lower region which is engaged with an enlarged region of the piston bore. The load transmitting member 28 is provided with a blind bore which defines, together with a reduced diameter region of the piston bore, a spring chamber 29 housing a compression spring 30. The spring 30 engages, at its lowermost end, a pin member 32 which cooperates with the enlarged region 12*a* of the valve needle 12, the other end of the spring 30 abutting the blind end of the bore provided in the load transmitting member 28 such that the spring 30 serves to urge the valve needle 12 in a downwards direction against its seating.

The outer surface of the piston member 24 at the region of interconnection between the regions 24*a*, 24*b* thereof defines, together with the bore 22, a chamber 34 for fuel. The projecting region 20*a* of the distance piece 20 is provided with a restricted drilling 37, one end of the drilling 37 communicating with the chamber 34 and the other end communicating with an accumulator volume 36 defined within an actuator housing 38. The housing 38 abuts, at its lowermost end, a surface of the distance piece 20, the nozzle body 10, the distance piece 20 and the lower part of the housing 38 being secured within a cap nut 70. In use, the drilling 37 permits fuel to flow from the accumulator volume 36 to the chamber 34 at a restricted rate.

The chamber 34 is provided with an annular valve member 59 which is engageable with a seating defined by the upper surface of the projecting region 20*a* to control direct communication between the chamber 34 and the accumulator volume 36. The annular valve member 59 is biased towards its closed position by means of a spring 57 located within the accumulator volume 36. In use, when fuel pressure within the chamber 34 exceeds fuel pressure within the accumulator volume 36, the annular valve member 59 is urged away from its seating against the action of the spring 57 to permit fuel to flow directly from the chamber 34 to the accumulator volume 36.

A piezoelectric stack 40, only the uppermost and lowermost parts of which are shown in FIG. 1, is housed within a sleeve member 35 which is arranged within the accumulator volume 36. The actuator housing 38 is provided with an inlet region 42 arranged to be coupled to a high pressure fuel line to permit connection of the fuel injector to the source of fuel under high pressure. The inlet region 42 houses an edge filter member 44 to remove particulate contaminants from the flow of fuel to the injector, in use, thereby reducing the risk of damage to the various components of the injector. The clean side of the filter formed by the edge filter member 44 communicates with the accumulator volume 36 by means of a drilling 46 provided in the housing 38, the drilling 46 forming part of the supply passage 14 for fuel passing from the inlet region 42 to the nozzle body 10. The lowermost end of the piezoelectric stack 40 is connected with an end member 48, a part of the lower surface of which is of part-spherical form and engages the part-spherical upper surface of the load transmitting member 28. The lower surface of the end member 48 is also provided with a recess which defines, together with a portion of the upper surface of the load transmitting member 28, a volume 50. The cooperation between the end member 48 and the load transmitting member 28 is such as to define a seal between these components, the seal being sufficient to restrict the flow of fuel into the volume 50 from the accumulator volume 36.

The upper end of the piezoelectric stack 40 is secured to a first terminal member 52, a second outer terminal member 54 surrounding a stem of the first terminal member 52 and an insulating spacer member 56 being located between the first and second terminal members 52, 54. A suitable adhesive is conveniently used to secure the first and second terminal members 52, 54 and the insulating spacer member 56 to other another. The first and second terminal members 52, 54 are in connection with an electrical connector 60 which is connected to a voltage source (not shown) to permit an appropriate voltage to be applied across the piezoelectric stack 40 to vary the energisation level thereof, and hence the axial length. A seal member 58 engages around part of the second terminal member 54, a further insulating spacer member 57*a* being located between the seal member 58 and the second terminal member 54. The seal member 58 includes a surface of part-spherical or part-spheroidal form which is arranged to seat with a correspondingly shaped surface of the accumulator volume 36 so as to substantially prevent fuel escaping from the accumulator volume 36 at its uppermost end.

The seal member 58 is provided with a drilling 61, a tubular member 63 being arranged within the accumulator volume 36 such that one end thereof communicates with the drilling 61 and the other end thereof communicates with the volume 50 defined between the end member 48 and the load transmitting member 28. The drilling 61 communicates with an annular chamber 65 defined within the housing 38, the annular chamber 65 being in communication with a passage or other chamber in communication with a low pressure drain. The tubular member 63 therefore defines a flow passage for fuel which permits the volume 50 to be vented to low pressure, in use. To prevent any fuel in the accumulator volume 36 contaminating the electrical connector 60, an annular seal member 62 is provided between the insulating spacer 57*a* and the vent chamber 65. Additionally, on assembly, the sleeve member 35 within which the piezoelectric stack is to be arranged may be molded in such a way that a lip portion 35*a* thereof is trapped so as to improve the seal between the accumulator volume 36 and the electrical connector 60.

In use, with the injector supplied with fuel from the source of pressurized fuel, and with the piezoelectric stack 40 having an energisation level at which the axial length of the stack is relatively long, the piston member 24 occupies a position in which fuel within the control chamber 18 is pressurized to a sufficient extent to ensure the force applied to the valve needle 12 by fuel under pressure within the control chamber 18, in combination with the action of the spring 30, is sufficient to hold the valve needle 12 in engagement with its seating. Under these circumstances, fuel under pressure within the delivery chamber 15 acting on the thrust surface of the valve needle 12 is insufficient to overcome the downward force on the valve needle 12 such that communication between the delivery chamber 15 and the outlet openings provided in the nozzle body 10 does not take place. During this stage of operation, the accumulator volume 36 is also filled with fuel under high pressure such that fuel is able to flow, via the drilling 37, into the chamber 34 defined between the projecting region 20*a* of the distance piece and the enlarged region 24*a* of the piston member 24.

In order to commence injection, the piezoelectric stack 40 is energized to a second energisation level causing the axial length of the piezoelectric stack 40 to be reduced. As the uppermost end of the piezoelectric stack 40 is held in a fixed position relative to the housing 38, the change in energisation level of the stack 40 to reduce the length thereof results in upward movement of the lower end of the stack 40. The movement of the lower end of the stack 40 is transmitted to the end member 48. As fuel within the volume 50 is able to vent through the tubular member 63 to the low pressure drain, the compressive load applied to the end member 48 and the load transmitting member 28 due to fuel pressure within the accumulator volume 36 causes these components to be urged together. Thus, throughout application of the retracting force to the load transmitting member 28 by the end member 48, there is a reduced risk of the components becoming separated.

As the piston member 24 is secured to the load transmitting member 28, the change in energisation level of the stack 40, and subsequent upward movement of the load transmitting member 28, results in movement of the piston member 24 in an upwards direction. Thus, as upward movement of the piston member 24 continues, the action of fuel under pressure within the control chamber 18 will reduce to a point beyond which the valve needle 12 is no longer held in engagement with its seating but is lifted therefrom due to the force applied to the thrust surface of the valve needle 12 by fuel pressure within the delivery chamber 15. Under these circumstances, with the valve needle 12 lifted away from its seating, fuel is able to flow from the delivery chamber 15 through the outlet openings and fuel injection commences.

When injection is to be terminated, the piezoelectric stack 40 is returned to its original energisation level, causing the end member 48 and the load transmitting member 28 to be moved in a downward direction, returning the piston member 24 to the position shown in FIG. 1. As a result, fuel pressure within the control chamber 18 is increased, thereby increasing the magnitude of the force applied to the valve needle 12. A point will be reached beyond which fuel pressure within the control chamber 18, in combination with the force due to the spring 30, is able to return the valve needle 12 into engagement with its seating, at which point fuel injection ceases.

Upon a reduction of the axial length of the piezoelectric stack 40 to cause upward movement of the piston member 24 and a reduction of fuel pressure within the chamber 18, fuel is drawn into the chamber 34 through the drilling 37 from the accumulator volume 36. This causes movement of the piston member 24 to be damped, resulting in opening movement of the valve needle 12 being damped. It is possible to damp opening movement of the valve needle 12 as the volume 50 is vented and this permits a greater retracting force to be applied to the piston member 24 for a longer period of time without the risk of separation of the end member 48 and the load transmitting member 28. Upon downward movement of the piston member 24 to increase fuel pressure within the control chamber 18, fuel pressure within the chamber 34 will increase, thereby causing the annular valve member 59 to lift away from its seating against the action of the spring 57. Under such circumstances, fuel pressure within the chamber 34 is relieved such that closing movement of the valve needle 12 is not damped. This ensures fuel injection can be terminated rapidly.

The effectiveness of damping movement of the piston 24 is also improved by arranging the spring 30 within the spring chamber 29 defined within the piston member 24 and the load transmitting member 28. Normally, the spring 30 is located within the control chamber 18. By moving the location of the spring member 30, the volume of the control chamber 18 can therefore be reduced.

Figure 2:
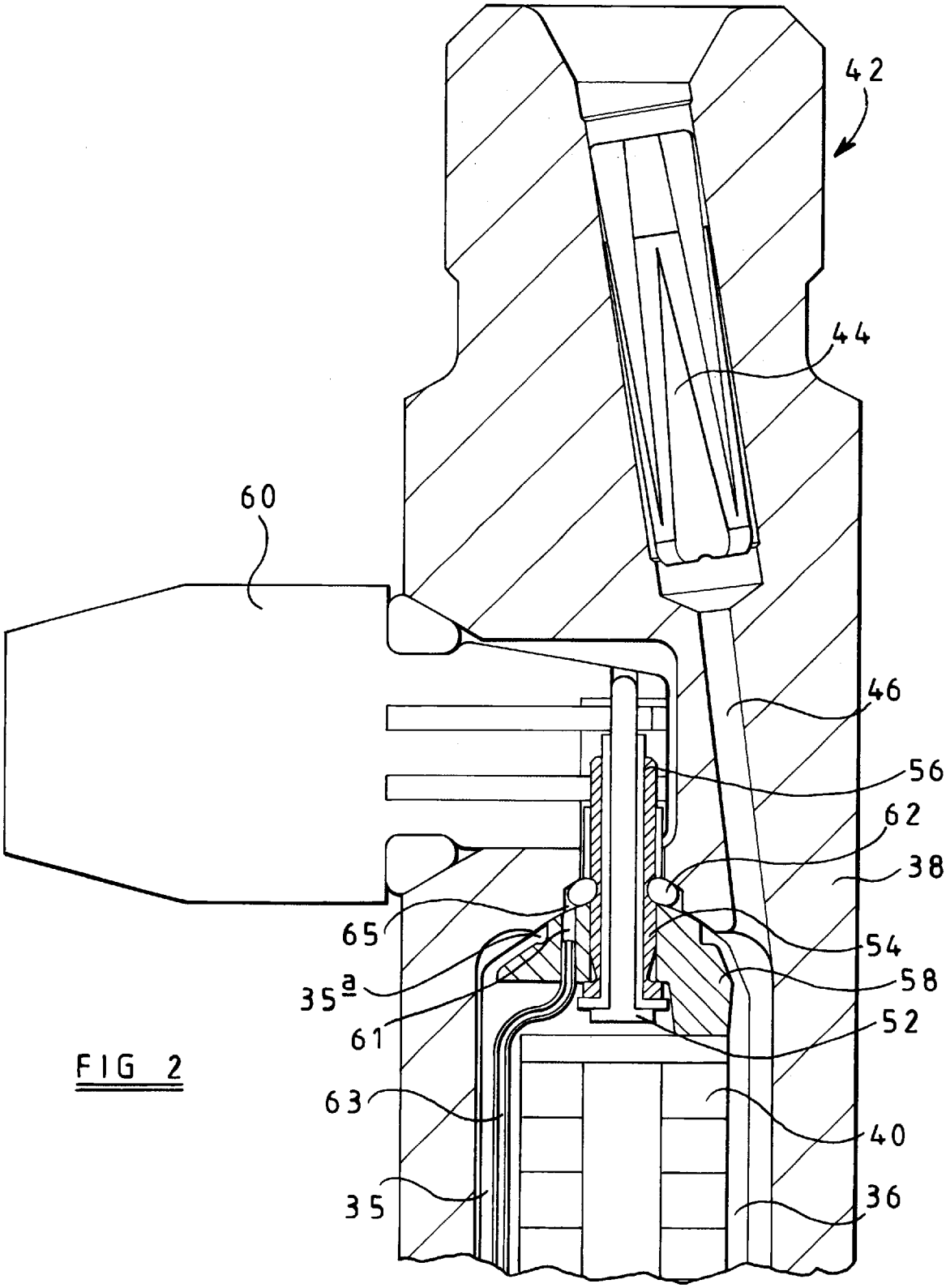
FIG. 2 is an enlarged sectional view of a part of an alternative embodiment of the present invention.

Referring to FIG. 2, in an alternative embodiment of the invention, the seal member 58 is formed from an electrically non-conductive material, for example a ceramic material, such that fewer insulating spacer members are required. As in the embodiment shown in FIG. 1, an annular seal member 62 is located within the chamber 65 to ensure fuel within the chamber 65 is unable to contaminant the electrical connector 60.

In a further alternative embodiment of the invention (not shown), the tubular member 63 may pass through a bore provided through the piezoelectric stack 40. Such piezoelectric stacks are, however, expensive to manufacture. In any of the embodiments herein described, the tubular member 63 may conveniently take the form of hypodermic needle tubing. Such tubing is particularly suitable as it has a relatively small diameter, can withstand the relatively high forces applied by fuel pressure within the accumulator volume 36 and has good corrosion resistance. As only a relatively small amount of fuel flows through the tubular member 63, in use, the bore of the tubular member may be partially filled with a wire or other strengthening means to reduce the risk of the tubular member being compressed by high pressure fuel within the accumulator volume 36.

Figure 3:
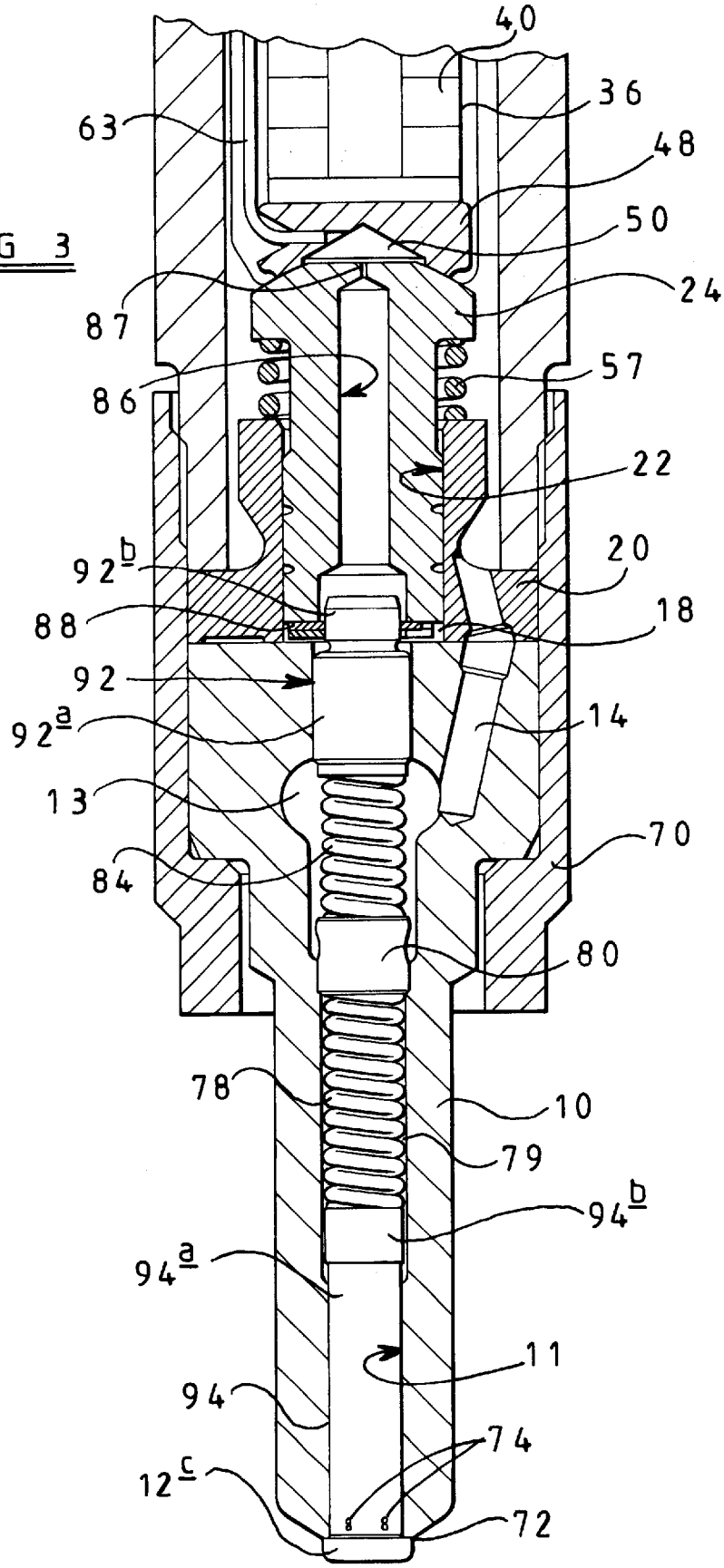
FIG. 3 is a sectional view of a part of a further alternative embodiment of the present invention.

Referring to FIG. 3, there is shown a fuel injector of the outwardly opening type in which similar parts to those shown in FIGS. 1 and 2 are denoted with the same reference numerals. The fuel injector includes a valve needle, only an enlarged end region 12*c* of which is visible in FIG. 3. The enlarged end region 12*c* of the valve needle is engageable with a seating 72 to control fuel delivery through outlet openings 74 provided in a sleeve member 94 received within the bore 11. The valve needle extends through the sleeve member 94, the sleeve member 94 including an enlarged region 94*b* and a region 94*a* of smaller diameter. The region 94*a* has a diameter substantially the same as the diameter of the adjacent part of the bore 11 which serves to guide sliding movement of the valve needle within the bore 11.

The sleeve member 94 is biased by means of a compression spring 78 and fuel pressure towards a position in which part of the lower surface of the sleeve member 94 engages the enlarged end region 12*c* of the valve needle to form a seal at the seating 72, the compression spring 78 being housed within a spring chamber 79. The other end of the spring 78 is in abutment with an annular abutment member 80, the abutment member 80 engaging, at its end remote from the spring 78, a second compression spring 84. The second compression spring 84 abuts, at its end remote from the abutment member 80, a lower region 92*a* of a piston member 92, the piston member 92 including an upper region 92*b* of reduced diameter which extends through the uppermost open end of the bore 11 into the bore 86 provided in the piston member 24. The region 92*b* of the piston member has a diameter substantially the same or slightly larger than the diameter of the region 94*a*. The compression spring 84 is pre-loaded such that it urges the enlarged region 12*c* of the valve needle against its seating 72 to prevent fuel delivery through the outlet openings 74. The outer surface of the valve needle and the inner surface of the sleeve member 94 together define a flow passage for fuel which communicates with the outlet openings 74, thereby permitting fuel to flow from the chamber 79 to the outlet openings 74, in use.

The bore 11 provided in the nozzle body 10, the piston member 92, the bore 22 and the piston member 24 together define the control chamber 18 for fuel. The control chamber 18 communicates with the accumulator volume 36 through leakage such that, in use, when the valve needle 12 adopts the position shown in FIG. 3, fuel pressure within the control chamber 18 is substantially the same pressure as fuel pressure within the accumulator volume 36.

The piston member 24 is provided with a blind bore 86 which is substantially co-axial with the bore 11 in the nozzle body 10, the blind end of the bore 86 communicating with a restricted drilling 87 provided in the piston member 24. The drilling 87 communicates with the volume 50 defined between the end member 48 and the piston member 24 such that, in use, in the position shown in FIG. 3, fuel pressure within the bore 86 is maintained at substantially the same level as fuel pressure within the volume 50. An annular seal member 88 is located within the control chamber 18, the seal 88 serving to seal the control chamber 18 from the bore 86 so as to substantially prevent fuel under high pressure within the control chamber 18 flowing into the bore 86. The seal 88 also accommodates any eccentricities between the bore 86 provided in the piston member 24 and the bore 11 in the nozzle body 10.

In use, fuel is supplied to the annular chamber 13 through the supply passage 14 and through the flow passage defined between the valve needle and the sleeve member 94 towards the outlet openings 74. As the volume 50 communicates, via the tubular member 63, with the low pressure drain, only a relatively low force is applied to the region 92*b* of the piston member 92. The control chamber 18 is filled with fuel under high pressure through leakage. As the diameter of the region 92*b* of the piston member 92 is substantially the same or slightly larger than the diameter of the region 94*a* of the sleeve member 94, in such circumstances the valve needle is substantially pressure balanced, the force due to the spring 84 serving to urge the valve needle against its seating 72 such that fuel injection does not take place.

When fuel injection is to be commenced, the piezoelectric stack 40 is energized to a level which causes the axial length thereof to increase. The end member 48 is therefore caused to move in a downwards direction, thereby transmitting movement to the piston member 24. Fuel pressure within the control chamber 18 therefore increases such that the downward force applied to the piston member 92 is increased. It will be appreciated that, as a substantially fluid tight sealed is formed between the control chamber 18 and the bore 86 by means of the seal member 88, fuel within the control chamber 18 is unable to escape to low pressure during inward movement of the piston member 24 within the bore 22. The increased force applied to the piston member 92 is transmitted to the valve needle and a point will be reached when the end region 12*c* of the valve needle moves away from the seating 72 against the spring force to expose the outlet openings 74. Fuel injection therefore takes place.

Outward movement of the valve needle can give rise to pressure waves in the tubular member 63, but any such pressure waves will be damped by means of the drilling 87 provided in the piston member 24 which serves to limit the rate at which fuel within the bore 86 is able to flow into the volume 50 and the tubular member 63.

In order to cease fuel injection, the piezoelectric stack 40 is de-energized to the original energisation level, thereby causing the axial length of the piezoelectric stack 40 to reduce. The seal formed between the end member 48 of the piezoelectric stack 40 and the piston member 24 causes the end member 48 to draw the piston member 24 in an upwards direction. As the volume 50 communicates with the low pressure chamber 65 by means of the tubular member 63, the end member 48 and piston member 24 are forced firmly together due to the compressive force applied to these components due to fuel under high pressure within the accumulator volume 36. The retracting force applied to the piston member 24 by the end member 48 causes the piston member 24 to move upwardly within the bore 22 to increase the volume of the control chamber 18. Fuel pressure within the control chamber 18 is therefore reduced and a point will be reached when the force is reduced sufficiently to cause the valve needle to return against its seating 72. When the valve needle seats against its seating 72, the outlet openings 74 are closed and fuel injection ceases. As the risk of separation of the end member 48 and the piston member 24 is reduced when the piston member 24 is drawn upwardly by the end member 48, the risk of fuel leakage from the injector at termination of injection is reduced.

It will be appreciated that, in order to inject fuel, fuel pressure within the control chamber 18 must be increased to an amount greater than the pressure of fuel within the accumulator volume 36, fuel pressure within the control chamber 18 being maintained at substantially the same pressure as fuel pressure within the accumulator volume 36 between fuel injections. In conventional fuel injectors of the outwardly opening type, the control chamber is at a relatively low fuel pressure between fuel injections such that, in the event that fuel leaks into the control chamber causing fuel pressure therein to increase, the valve needle can be held away from the seating for a longer period than desired, adversely affecting operation of the fuel injector. This problem is avoided by the fuel injector in FIG. 3.

A further advantage of maintaining fuel with the control chamber 18 at high pressure between injections is that the fuel bulk modulus is higher and the risk of cavitation is eliminated, thereby improving control of valve needle movement.

It will be appreciated that the fuel injectors herein may be provided with a different number of outlet openings to those described. In particular, the fuel injectors may of the two-stage lift type, in which the fuel injection characteristic can be varied, in use, depending on the extent of movement of the valve needle away from its seating.

We claim:

1. A piezoelectrically actuable fuel injector comprising an accumulator volume within which a piezoelectric stack is arranged, the accumulator volume being arranged to receive fuel from a source of pressurized fuel, in use, the piezoelectric stack carrying an end member which engages a surface associated with a piston member so as to apply a retracting force to the piston member upon a reduction in the axial length of the piezoelectric stack, the piston member being operable to control fuel pressure within a control chamber, a volume being defined between the end member and the surface associated with the piston member, the volume being provided with a vent arrangement to permit fuel within the volume to flow to a low pressure drain.

2. A fuel injector as claimed in claim 1, wherein the vent arrangement takes the form of a passage, one end of the passage communicating with the volume and the other end of the passage communicating with the low pressure drain.

3. A fuel injector as claimed in claim 2, wherein the passage is defined by a tubular member housed within the accumulator volume.

4. A fuel injector as claimed in claim 2, wherein the piezoelectric stack is provided with a first bore, the passage being defined by a tubular member passing through the first bore of the stack.

5. A fuel injector as claimed in claim 2, wherein the passage is defined by a first bore provided in the piezoelectric stack.

6. A fuel injector as claimed in claim 1, wherein the piston member includes a load transmitting member which defines the surface which engages the end member.

7. A fuel injector as claimed in claim 6, comprising a spring chamber defined within the piston member and the load transmitting member for housing a compression spring which serves to urge a valve needle of the injector against a seating.

8. A fuel injector as claimed in claim 1, comprising a valve needle which is slidable within a second bore and engageable with a seating to control fuel delivery through one or more outlet openings.

9. A fuel injector as claimed in claim 8, wherein the fuel injector is of the inwardly opening type in which inward movement of the valve needle within the second bore away from the seating causes fuel injection to be commenced.

10. A fuel injector as claimed in claim 9, comprising a damping arrangement for damping movement of the piston member upon a reduction of the axial length of the piezoelectric stack.

11. A fuel injector as claimed in claim 10, wherein the damping arrangement comprises a further chamber for fuel, the further chamber communicating with the accumulator volume by means of a restricted flow passage.

12. A fuel injector as claimed in claim 11, wherein the further chamber is provided with a valve arrangement operable in response to fuel pressure within the further chamber such that, upon movement of the piston member to reduce the volume of the further chamber, the valve arrangement is caused to open to relieve fuel pressure within the further chamber.

13. A fuel injector as claimed in claim 8, wherein the fuel injector is of the outwardly opening type such that movement of the valve needle outwardly within the second bore away from the seating causes fuel injection to be commenced.

14. A fuel injector as claimed in claim 13, wherein the piston member is provided with a piston bore which communicates with the volume, a first surface associated with the piston member being exposed to fuel pressure within the piston bore and a second surface of the piston member being exposed to fuel pressure within the control chamber.

15. A fuel injector as claimed in claim 13, wherein the control chamber communicates with the accumulator volume such that, in use, during non-injecting stages of the injection cycle, fuel pressure within the control chamber is substantially the same as fuel pressure within the accumulator volume.

* * * * *